United States Patent [19]

Böttcher et al.

[11] 4,126,105

[45] Nov. 21, 1978

[54] BOILER WITH HORIZONTAL BOILER SECTIONS

[76] Inventors: Kurt Böttcher, Konrad Adenauer Strasse 1, Nieder-Ramstadt, Germany, D 6101; Peter Metz, Drei Linden Strasse 17, Neuenhain, Germany, D 62 32

[21] Appl. No.: 800,392

[22] Filed: May 25, 1977

[30] Foreign Application Priority Data

May 26, 1976 [DE] Fed. Rep. of Germany ..... 2623632

[51] Int. Cl.[2] ..... F22B 15/00

[52] U.S. Cl. ..... 122/214; 122/218; 165/130

[58] Field of Search ..... 122/214, 216, 210, 218; 165/130

[56] References Cited

U.S. PATENT DOCUMENTS

| | | | |
|---|---|---|---|
| 693,870 | 2/1902 | Kuen et al. | 122/214 |
| 2,651,506 | 9/1953 | Lehmann | 165/130 |
| 3,408,989 | 11/1968 | Baier | 122/214 |

*Primary Examiner*—Kenneth W. Sprague
*Attorney, Agent, or Firm*—Bacon & Thomas

[57] ABSTRACT

Boilers with horizontal boiler sections contain in each section several heat exchanger elements for transferring the heat from the heating medium to the heat carrier medium. They have the inherent advantage of needing a connection between sections only on one side so that the dimensional changes during operations are easily equalized and no thermal stresses occur. Heretofore, it has been assumed that the frame of such horizontal boiler sections in which the heat exchanger elements in the form of pipes are secured must be provided with a cooling channel for the liquid heat carrier medium, and consequently the specific heat output in relation to the amount of material used for the construction of the boiler section was considerably decreased.

The boilers with horizontal sections in accordance with the invention overcome this problem and require only a reduced specific amount of material as compared with the known boilers of this type. This is achieved by providing the boiler sections with a solid frame which is in heat conductive contact with at least the adjacent pipe or pipes conducting the heat carrier medium by means of the fin or fins provided on the pipes, preferrably by means of an uninterrupted material to material contact. In an embodiment with a more extensive connection between the frame and the pipes the fins on the pipes form continuous cross bars, and also a turbulent flow of the flue gas can be obtained.

5 Claims, 5 Drawing Figures

BOILER WITH HORIZONTAL BOILER SECTIONS

BACKGROUND OF THE INVENTION

The present invention relates to a boiler with horizontal boiler sections consisting of several horizontal heat exchanger elements for transferring the heat from the heating medium to the heat carrier medium, wherein at least the inner heat exchanger elements consist of pipes carrying the heat carrier medium which are provided with exterior convection fins.

In a known boiler of this type the boiler sections consist of a frame conducting the heat carrier medium, i.e. the frame contains an inner surrounding liquid channel, wherein depending on the size of the boiler a number of pipes are secured in the frame as additional heat exchanger elements and are in flow communication with the frame channel. The vertical channel connection of the boiler sections is achieved through vertical pipes which are connected with the frame channel.

Boilers with horizontal boiler sections have several significant advantages over boilers with vertical boiler sections, especially the advantage, that the sections have to be interconnected only on one side of each section, so that the unavoidable dimensional changes during the operation and due to the heating can equalize without developing thermal stresses. Their disadvantage compared to the boilers with vertical boiler sections especially consists in the fact that the known horizontal boiler sections have a lower specific heat output — in relation to the amount of material used — than the vertical boiler sections and therefore require a larger specific amount of material used for the construction of the frame and the boiler section, increasing its weight and its cost.

The present invention has the object of providing a boiler with horizontal boiler sections which requires a substantially reduced specific amount of material used as compared with the known boilers of this type.

In accordance with the invention this object is achieved by providing a boiler with boiler sections consisting of a compact frame in which the pipes conducting the heat carrier medium are secured, wherein this frame is at least in heat conductive contact with the adjacent pipe or pipes by means of the fins provided on the pipe or pipes, and preferrably is connected with the pipe or pipes by means of an uninterrupted material to material contact.

Unexpectedly, it has been found, that the fins — in the case of a connection to the frame elements — besides taking up the heat from the flue gas and transferring it to the heat carrier medium contained in the associated pipe are also capable of conducting the heat taken up by the frame elements to the interior elements, so that in contrast to the formerly held assumptions a separate direct cooling of the frame by means of a heat carrier medium is not necessary. In this, generally a connection of the longitudinal frame members with the immediately adjacent heat carrier pipe is sufficient. However, it is also possible to provide a more extensive connection, wherein the convection fins form continuous cross bars. In this an arrangement is suitable in which the pipes carrying the heat carrier medium in boiler sections arranged on top of each other are also arranged on top of each other and their fins have a relative displacement. By means of this an optimum heat conduction is obtained — by means of a suitable design in this also a turbulent flow of the flue gas can be obtained — as well as a proper access from above to the surfaces in contact with the flue gas for cleaning purposes.

In a further alternative embodiment the fins of the individual boiler sections can be shaped so that they extend only as far as the splitting plane of the mold pattern. The fins of the other part of the pattern are then extending into the intermediate spaces. This embodiment has the advantage that all boiler sections are equal and thus only one mold pattern is needed for a design in which the heat carrier medium is supplied and discharged on one side in a common pipe for the whole boiler consisting of several boiler sections.

Furthermore, it is advantageous to provide "turbulators" in the form of deflector plates or vanes within the pipes at the levels of the heat conducting fins. On one hand these deflector plates increase the surface available for the heat transfer to the heat carrier medium and on the other hand create a turbulent flow in the heat carrier medium, thus preventing local overheating and therefore the occurence of boiling noises.

DESCRIPTION OF EMBODIMENTS

The invention together with the above and other objects and advantages will become more readily apparent from the following description of preferred embodiments in connection with the drawings, which is given by way of an example and is not intended to limit the scope of the invention.

Figure 1:
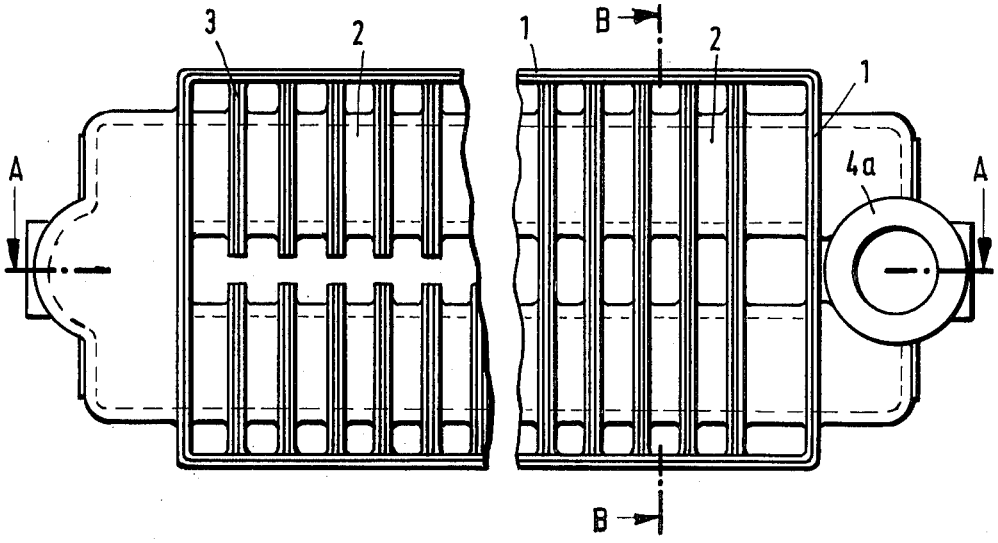
FIG. 1 shows a plan view of a boiler section.
Figure 2:
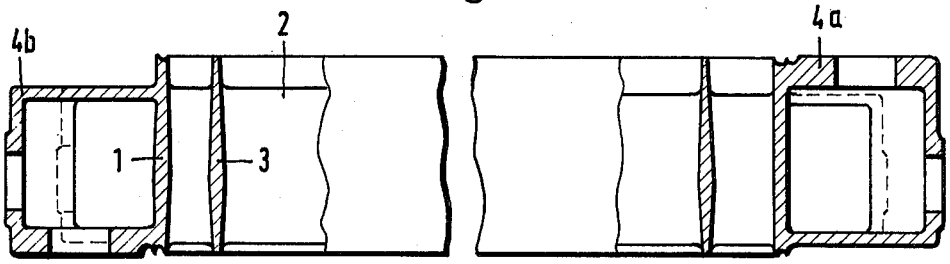
FIG. 2 shows a partial cross section along the line A—A of FIG. 1.
Figure 3:
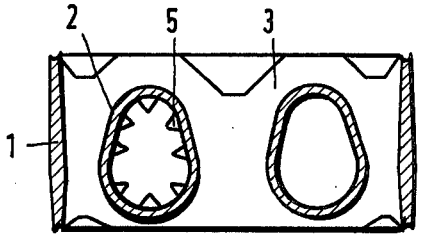
FIG. 3 shows a cross section along the line B—B in FIG. 1.
Figure 4:
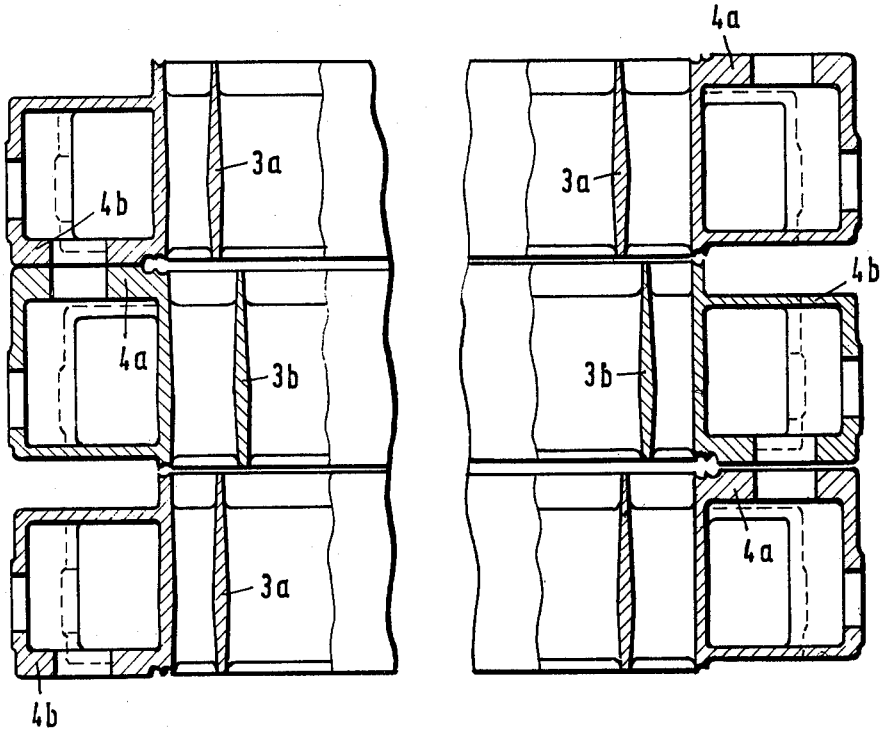
FIG. 4 shows three superimposed sections of a boiler.

The boiler section illustrated in the drawings contains a compact frame 1 in which pipes 2 conducting the heat carrier medium are secured, and the frame 1 is connected with the pipes by means of the fins 3. The boiler section is cast in one piece so that a material connection between the frame and the fins exists. FIG. 1 shows the fins 3 partly as continuous fins bridging the whole width of the frame (on the right half) and partly as fins only extending as far as the adjacent pipe (on the left half). The pipes have a connection to the vertical pipe **4*a* with an upper opening 4*b* and a lower opening for alternate connection (see FIG. 4) of the sections at their ends, so that an enforced circulation of the heat carrier medium through all sections is achieved. Furthermore, (see FIG. 3) turbulators 5 are disposed within the pipes 2 in the region of the connection to the outer fins 3. This embodiment, in addition to the advantages regarding the conduction of the liquid, has the further advantage that due to a suitable displaced positioning of the fins 3 only sections of one form are needed to build up a boiler with fins 3*a* or 3*b* in accordance with FIG. 4** which are displaced from one layer to the next, where these sections are merely stacked with a displacement of 180°.

Figure 5:
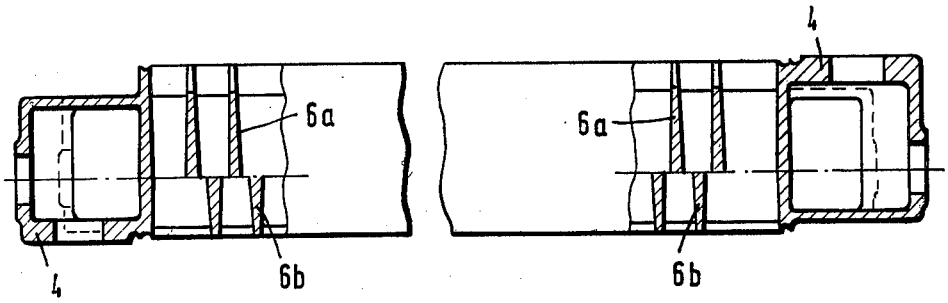
FIG. 5 shows a partially sectional view of an alternate embodiment of a boiler section in a view corresponding to FIG. 2.

Furthermore, also a one sided connection of the boiler sections and a division of the connecting pipe into two halves may be provided. However, in this case it is suitable to use boiler sections of the type shown in FIG. 5, in which the fins 6, **6*a*** are mutually displaced and extend as far as a splitting line.

As used in the above description and in the claims the term "compact frame" means a frame for the horizontal boiler section, which in contrast to the formerly used frames for boiler sections of this type does not contain an interior frame channel for circulation of the heat carrier medium (liquid) used for the purpose of cooling the frame.

An important figure of merit for a boiler section is the ratio between the material (metal) used for the construction of the boiler section and the heat output of the boiler. By using the above described inventive "compact frames" without interior frame channels for a separate cooling of the frame exceptionally favourable values for this ratio are obtained. In conventional cast boiler sections at best a value of 3.2 kg cast iron/Mcal (megacalories) of heat output of the boiler for horizontal sections and 2.8 kg cast iron per Mcal heat output for vertical boiler sections has been obtained before. With the boiler with horizontal sections in accordance with the invention a value of down to 2.2 kg cast iron per Mcal heat output has so far been achieved with embodiments of the inventive boiler sections without any danger of overheating in the boiler section. Thus, in accordance with the invention, the inherent advantages of horizontal boiler sections are maintained and the material used per unit of heat output is considerably improved over the known boilers of both types.

What we claim is:

1. Boiler with horizontal boiler sections consisting of a plurality of horizontal heat exchanger elements for transfer of heat from a heating medium to a heat carrier medium, wherein at least some of the elements consist of a plurality of pipes carrying the heat carrier medium and are provided with exterior fins, the boiler section consisting of a compact frame in which the pipes conducting the heat carrier medium are secured and which is in heat conductive connection with the adjacent pipe by means of the fins provided on the pipes, the frame preferably being connected with the pipe by an integral material to material contact.

2. Boiler of claim 1, wherein said pipes carrying the heat carrier medium are superimposed for superimposed boiler sections and said heat conducting fins are mutually laterally displaced.

3. Boiler of claim 1, wherein in the interior of said pipes turbulators in the form of deflecting plates or ribs or flow resistance ribs are provided inwardly of said heat conducting fins.

4. Boiler of claim 1, wherein each of said boiler sections comprises mated halves joined along a splitting plane, said heat conducting fins extending only to said splitting plane.

5. Boiler according to claim 1, wherein the ratio of the weight of the material used for construction of the boiler section to the heat output of the boiler is between about 2.8 kg/Mcal and 2.2 kg/Mcal (1000 kcal) or less.

* * * * *